US010589350B2

(12) United States Patent
Choi et al.

(10) Patent No.: US 10,589,350 B2
(45) **Date of Patent: *Mar. 17, 2020**

(54) RAPID-COOLING SOLIDIFICATION APPARATUS WITH INDEPENDENTLY CONTROLLABLE CHAMBER

(71) Applicant: ILJIN ELECTRIC CO., LTD., Hwaseong (KR)

(72) Inventors: Young Pil Choi, Ansan (KR); Cheol Ho Park, Suwon (KR); Min Hyun Kim, Seoul (KR); Myeong Han Kim, Ansan (KR)

(73) Assignee: ILJIN ELECTRIC CO., LTD., Hwaseong-si (KR)

( * ) Notice: Subject to any disclaimer, the term of this patent is extended or adjusted under 35 U.S.C. 154(b) by 87 days.

This patent is subject to a terminal disclaimer.

(21) Appl. No.: 15/522,624

(22) PCT Filed: Oct. 19, 2015

(86) PCT No.: PCT/KR2015/011025
§ 371 (c)(1),
(2) Date: Apr. 27, 2017

(87) PCT Pub. No.: WO2016/076545
PCT Pub. Date: May 19, 2016

(65) Prior Publication Data

US 2017/0312814 A1 Nov. 2, 2017

(30) Foreign Application Priority Data

Nov. 11, 2014 (KR) ..... 10-2014-0156303

(51) Int. Cl.
*B22D 11/112* (2006.01)
*B22D 11/113* (2006.01)
(Continued)

(52) U.S. Cl.
CPC ..... *B22D 11/112* (2013.01); *B22D 11/0611* (2013.01); *B22D 11/113* (2013.01); *B22D 11/124* (2013.01); *B22D 21/025* (2013.01)

(58) Field of Classification Search
CPC . B22D 11/06; B22D 11/0611; B22D 11/0682; B22D 11/112; B22D 11/113; B22D 11/124; B22D 21/025
(Continued)

(56) References Cited

U.S. PATENT DOCUMENTS 3,658,119 A * 4/1972 Hunt et al. ..... B22D 11/113 164/258
4,449,568 A 5/1984 Narasimham
(Continued)

FOREIGN PATENT DOCUMENTS

JP 60-024247 A 2/1985
JP 62-156053 A 7/1987
(Continued)

*Primary Examiner* — Kevin P Kerns
(74) *Attorney, Agent, or Firm* — Patent Office of Dr. Chung Park

(57) ABSTRACT

Disclosed is a continuous rapid solidification apparatus, which has a cooling roll configured to cool a molten metal supplied to an outer circumference surface thereof; a crucible configured to supply the cooling roll with the molten metal; a molten metal supply configured to melt a raw material metal and supply the crucible with the molten metal; a first chamber configured to form a sealed space where the molten metal supplied from the crucible is cooled by the cooling roll; and a second chamber configured to be formed of a space separated from the first chamber and to form a sealed space where the molten metal is supplied to the crucible by the molten metal supply.

6 Claims, 5 Drawing Sheets

(51) Int. Cl.
*B22D 11/124* (2006.01)
*B22D 11/06* (2006.01)
*B22D 21/02* (2006.01)

(58) Field of Classification Search
USPC .... 164/423, 429, 437, 449.1, 453, 462, 463, 164/479
See application file for complete search history.

(56) References Cited

U.S. PATENT DOCUMENTS

| | | | | |
|---|---|---|---|---|
| 4,617,982 | A | 10/1986 | Tanimura et al. | |
| 5,028,277 | A * | 7/1991 | Mizoguchi et al. ... | B22D 11/06 148/403 |
| 5,305,816 | A * | 4/1994 | Ikawa ..... | B22D 23/003 164/46 |
| 2010/0202917 | A1* | 8/2010 | Nakajima ..... | B22F 1/0055 420/591 |
| 2015/0027592 | A1* | 1/2015 | Shibasaki et al. ..... | B22D 11/10 148/403 |
| 2017/0320130 | A1* | 11/2017 | Choi et al. ..... | B22D 11/0682 |

FOREIGN PATENT DOCUMENTS

| | | | |
|---|---|---|---|
| JP | 63-260287 | A | 10/1988 |
| JP | 63-260687 | A | 10/1988 |
| WO | 00-47351 | A1 | 8/2000 |

* cited by examiner

RAPID-COOLING SOLIDIFICATION APPARATUS WITH INDEPENDENTLY CONTROLLABLE CHAMBER

TECHNICAL FIELD

The present invention relates to an independent control chamber type rapid solidification apparatus, and more specifically, to a rapid solidification apparatus, capable of being controlled independently to enhance the yield of alloy.

BACKGROUND ART

Recently, a lithium secondary battery applies to transportation application field such as Hybrid Electric Vehicle HEV, Plug-in Hybrid Electric Vehicle PHEV and Electric Vehicle EV, and high electric power consumption field such as Smart Grid application electric power storage.

According to such tendency, it is promoted to change the electrode material, enhance the coating technology, enhance the packing technology and enhance the lithium absorption rate in cathode, in order to enhance energy density of the secondary battery. However, means except for the change of the electrode material has been developed by the optimized internal space and design in the art, and it is currently known that the means reached the limit.

Recently, a research is being carried out to use Si series alloy and Sn series alloy as the anode active material in order to enhance the energy density of the lithium secondary battery. When the Si series is used as a cathode material, it may be expected to obtain the theoretical capacity (4010 Ah/Kg) which is 10 times the theoretical capacity of Graphite (372 Ah/Kg), so that it is considerably excellent in the energy density.

However, while the theoretical volume change rate of graphite is 12%, that of silicon is 300% to 400%, which is 20 times or more. Therefore, in case that Si series alloy is used as the anode active material, particles gradually come out due to the expansion of the alloy by the volume change in the procedure that the lithium ion comes into and out of the cathode material while charging and discharging repeatedly, so that there occurs a drawback in that the cycle characteristic is declined. When the volume change of an active material is great, there occur a crack of the active material particle and a loose contact between the active material and a current collector so that there also occurs a problem that the life of charging and discharging cycle becomes shortened.

Especially, when there occurs a crack in the active material particle, since surface area of the active material particle becomes increased, the reaction between the active material particle and a non-aqueous electrolyte becomes increased, whereby a film composed of decomposition product of the non-aqueous electrolyte is easily formed on the surface of the active material. When such a film is formed, an interfacial resistance between the active material and the non-aqueous electrolyte becomes increased, causing the life of the charging and discharging cycle to be shortened. In order to solve such a problem, a composition of the material used as the anode active material should be uniformly formed.

The anode active material of Si series may be manufactured using the melt spinning method, and a conceptual view for a manufacturing apparatus employing the melt spinning method is illustrated in FIG. 1. The manufacturing apparatus employing the melt spinning method includes a crucible 501 to melt and contain an alloy of a raw material, and a rotation roller 503 which contacts a molten alloy 502 discharged from the crucible 501. The molten alloy 502 discharged from the crucible 501 is cooled in contact with the rotation roller 503, and the product thereof is formed in a ribbon type.

In case of such a manufacturing apparatus, however, when the molten raw material is wholly exhausted, there is needed an additional work for exchanging, such as opening a sealed apparatus in order to replenish the raw material again, so that the work continuity is declined. Further, the total process is delayed since the raw material supplied again should be melted.

INVENTION

Technical Problem

The present invention provides a continuous rapid solidification apparatus, capable of performing a vacuum process in a cooling chamber in which molten metal is supplied to a cooling roll and cooled, and at the same time independently controlling a chamber in which the molten metal is supplied and cooled.

Further, the present invention provides a continuous rapid solidification apparatus that includes a control means to supply a cooling roll with the molten metal at a constant pressure regardless of an exhausted level of the molten metal contained in the crucible.

The present invention provides a continuous rapid solidification apparatus, capable of continuously supplying molten metal, so that the apparatus opening to replenish a raw material metal to be melted is minimized and the work continuity is maintained to the greatest extent possible.

Further, the present invention provides a continuous rapid solidification apparatus having a structure with which a sequential supply of the molten metal is easily performed.

Technical Solution

In accordance with an embodiment of the present invention, there is provided a continuous rapid solidification apparatus, which comprises a cooling roll configured to cool a molten metal supplied to an outer circumference surface thereof; a crucible configured to supply the cooling roll with the molten metal; a molten metal supply configured to melt a raw material metal and supply the crucible with the molten metal; a first chamber configured to form a sealed space where the molten metal supplied from the crucible is cooled by the cooling roll; and a second chamber configured to be formed of a space separated from the first chamber and to form a sealed space where the molten metal is supplied to the crucible by the molten metal supply.

Preferably, the continuous rapid solidification apparatus may further comprise a pressure controller configured to control the pressure of the second chamber.

Preferably, the pressure controller may provide an inert gas into the second chamber to control the pressure therein.

Preferably, the continuous rapid solidification apparatus may further comprise a controller configured to control the pressure controller so as to increase the pressure of the second chamber in proportion to the exhausted status of the molten metal supplied to the crucible.

Preferably, the continuous rapid solidification apparatus may further comprise a vacuum level controller configured to control the vacuum level of the first chamber.

Preferably, the continuous rapid solidification apparatus may further comprise a controller configured to control the vacuum level controller so as to increase the vacuum level of the first chamber in proportion to the exhausted status of the molten metal supplied to the crucible.

Preferably, the vacuum level of the first chamber maybe controlled in the scope of 0.1 to 10 torr.

Preferably, the continuous rapid solidification apparatus may further comprise a pressure controller configured to control the pressure of the second chamber; and a controller configured to control the vacuum level controller and the pressure controller so as to increase the vacuum level of the first chamber and the pressure of the second chamber in proportion to the exhausted state of the molten metal supplied to the crucible.

Preferably, two or more the molten metal supplies may be included so that the crucible is sequentially supplied with the molten metal.

Preferably, the molten metal supply may be a melting furnace that melts the raw material metal contained therein.

Preferably, the molten metal supply may comprise an auxiliary crucible chamber configured to include an internal heater; a gate configured to open and close the auxiliary crucible chamber; and an auxiliary crucible configured to melt the raw material metal in the auxiliary crucible chamber and to be transported toward the crucible when the gate is opened so as to supply the crucible with the molten metal.

Preferably, the continuous rapid solidification apparatus may further comprise a continuous supply controller configured to control the opening and closing of the gate and the transportation of the auxiliary crucible such that the molten metal is sequentially supplied from the plurality of molten metal supplies.

Advantageous Effects

According to the present invention, a supply chamber to supply the crucible with the molten metal and a cooling chamber in which the molten metal is supplied to a cooling roll and cooled are partitioned as independent sealed spaces, respectively, so that it is possible to perform a vacuum process. At the same time, a chamber in which the molten metal is supplied and a cooling process is performed is controlled independently so that the yield of product may be enhanced.

Further, according to the present invention, the pressure of the supply chamber and the vacuum level of the cooling chamber are controlled independently or simultaneously, so that the cooling roll may be provided with the molten metal at a constant pressure regardless of the exhausted level of the molten metal contained in the crucible.

According to the present invention, it is possible to supply a molten metal sequentially using a plurality of auxiliary crucibles or melting furnaces, so that apparatus opening to replenish a raw material metal to be melted is minimized and work continuity is maintained to the greatest extent possible.

BEST MODE

Figure 1:
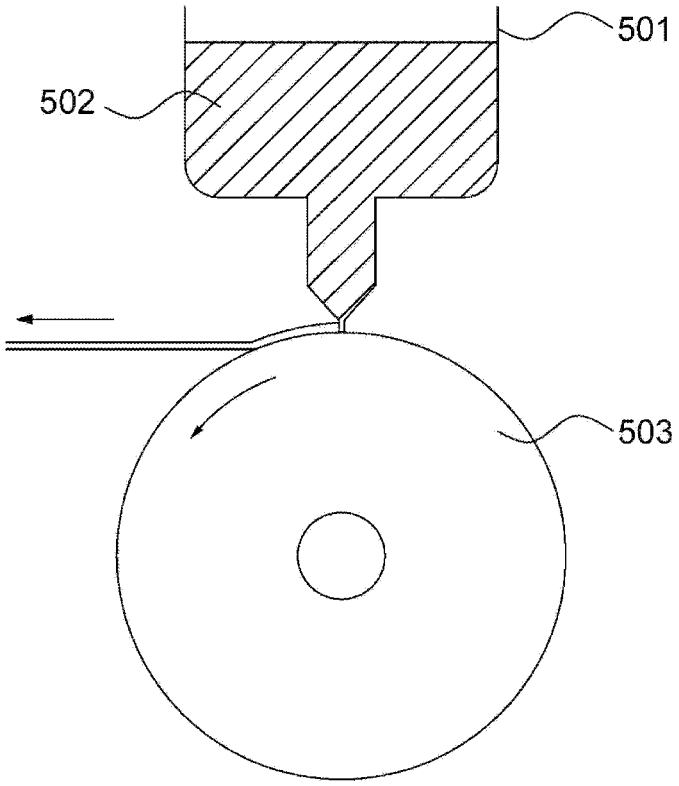
FIG. 1 (PRIOR ART)
FIG. 1 is a schematic view illustrating a manufacturing apparatus employing the melt spinning method in the art.

A continuous rapid solidification apparatus according to the present invention comprises a cooling roll configured to cool a molten metal supplied to an outer circumference surface thereof; a crucible configured to supply the cooling roll with the molten metal; a molten metal supply configured to melt a raw material metal and supply the crucible with the molten metal; a first chamber configured to form a sealed space where the molten metal supplied from the crucible is cooled by the cooling roll; and a second chamber configured to be formed of a space separated from the first chamber and to form a sealed space where the molten metal is supplied to the crucible by the molten metal supply.

MODES

Hereinafter, embodiments of the present invention will be described with reference to the accompanying drawings. When not defined or mentioned explicitly otherwise, the terms used to indicate directions in the description are based on the status illustrated in the drawings. Further, the same reference numerals are used to indicate the same components throughout respective embodiments. Meanwhile, each component illustrated in the drawings may be exaggerated in its thickness and dimension for the convenience of description, and it does not mean that each embodiment should be configured in its practical dimension or configuration ratio.

Figure 2:
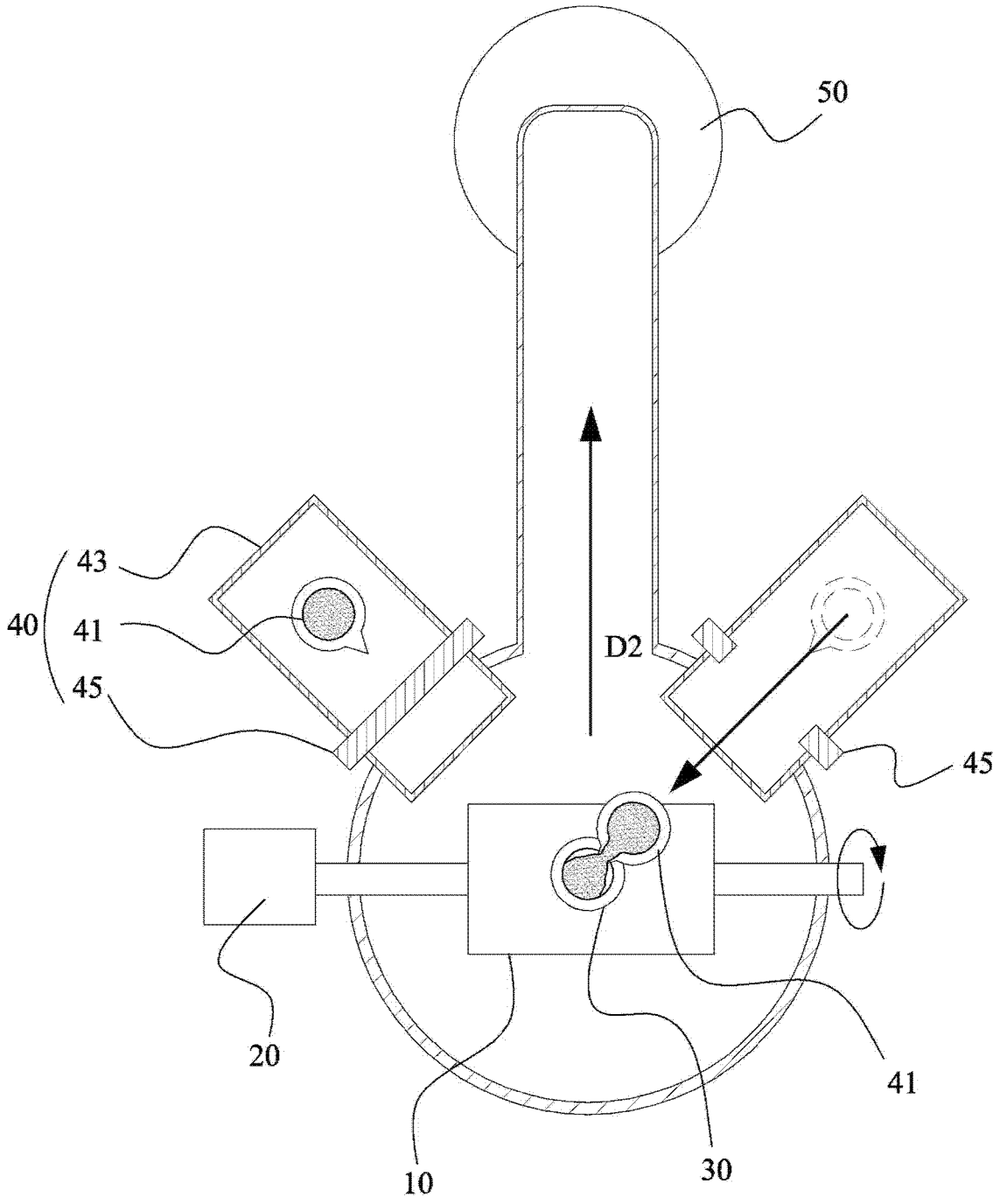
FIG. 2 is a typical plan view illustrating a rapid solidification apparatus according to an embodiment of the present invention.
Figure 3:
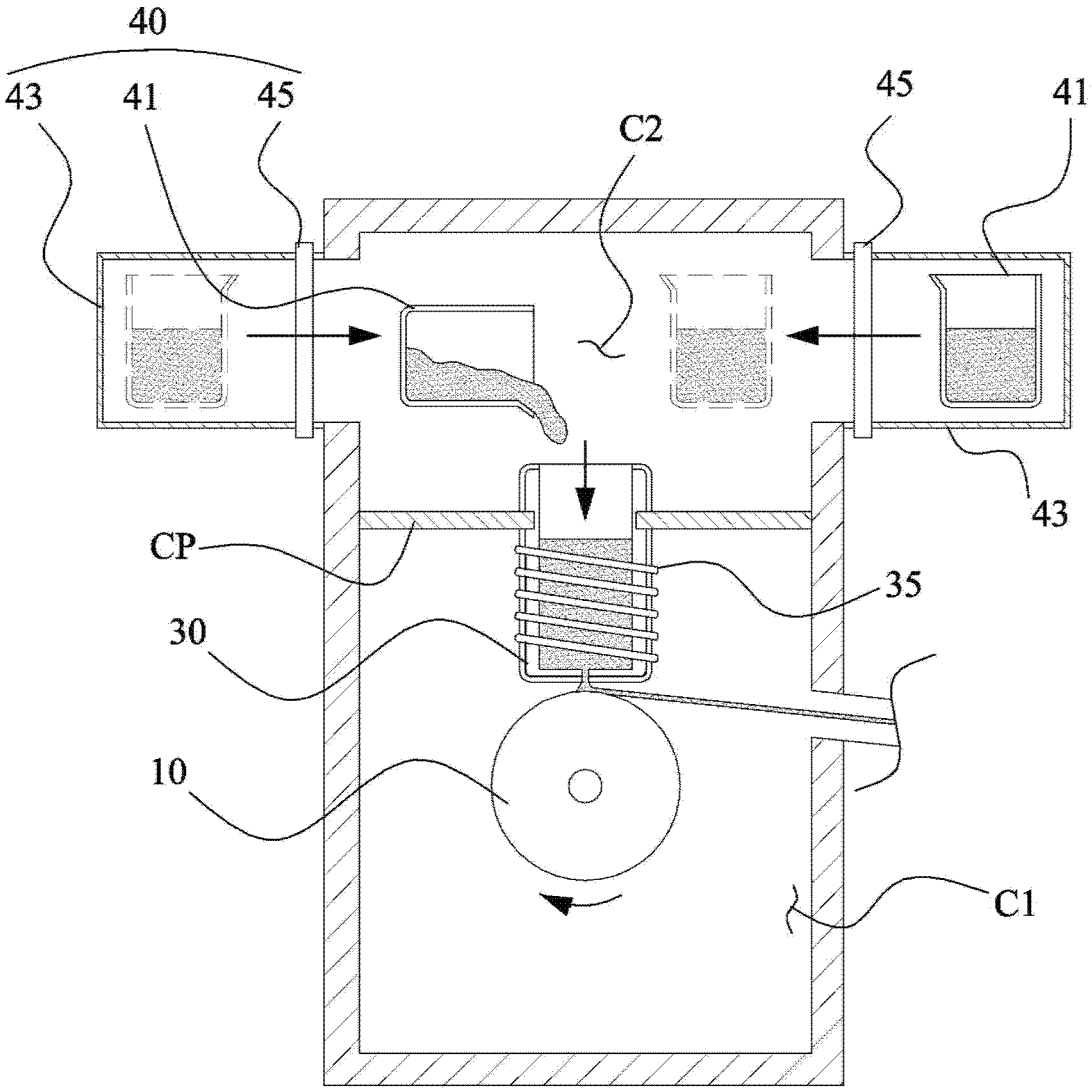
FIG. 3 is a typical vertical sectional view illustrating a rapid solidification apparatus according to an embodiment of the present invention.

A continuous rapid solidification apparatus according to an embodiment is described with reference to FIGS. 2 and 3. FIG. 2 is a typical plan view illustrating a rapid solidification apparatus according to an embodiment of the present invention and FIG. 3 is a typical vertical sectional view illustrating a rapid solidification apparatus according to an embodiment.

A cooling roll 10 cools a molten metal, that is, a liquid metal supplied from a crucible 30. Specifically, the cooling roll 10 receives a rotation force from a motor 20 so that it rotates around a certain axis of rotation. The cooling roll 10 cools the supplied molten metal using its outer circumference surface whose temperature is relatively lower than the molten metal and then scatters it in a certain direction D2.

A cooled material such as a ribbon type alloy, which is cooled by the cooling roll 10 and flows in a certain direction D2 is rolled up and stored in a storage 50.

The crucible 30 is located on the cooling roll 10 and supplies the outer circumference surface of the cooling roll 10 with the molten metal contained therein. Specifically, the crucible 30 is supplied with the molten metal from a molten metal supply 40. The molten metal contained in the crucible 30 is heated by a heater 35 which is adjacent thereto or included therein so that it is controlled at a suitable temperature.

Two or more molten metal supplies 40 are included. Each of the molten metal supplies 40 melts a raw material metal and sequentially supplies the crucible with the molten metal. In this case, while any one of the molten metal supplies 40 supplies the crucible 30 with the molten metal, remaining molten metal supplies 40 is heated to melt the metal to be supplied in the next time or stands by with keeping the temperature. Also, each of the molten metal supplies 40 controls the amount of the molten metal that is continuously supplied to the molten metal supply 40 according to the tapping speed of the molten metal contained in the crucible 30. That is, it is desired that the molten metal supply 40 replenishes the amount of the molten metal tapped from the crucible 30 so that a certain level of metal is maintained in the crucible 30.

In this case, various devices may be used to sense the level of the molten metal contained in the crucible 30. For example, it may be possible to sense the level of the molten metal by partially measuring the temperature using a number of bimetals or the like, which are included in the crucible 30. Further, it may be possible to sense the level of the molten metal contained in the crucible 30 through an image process by installing an imaging device (not shown) to take a picture of an interior of the crucible 30.

Specifically, the molten metal supply 40 includes an auxiliary crucible chamber 43, an auxiliary crucible 41 and a gate 45. The auxiliary crucible 41 contains a raw material metal and/or a molten metal in order to manufacture a molten metal to be supplied to the crucible 30. The auxiliary crucible chamber 43 provides a sealed space that includes heaters to heat the auxiliary crucible 41 thereby producing the molten metal or maintaining the temperature, and the gate 45 opens and closes the crucible chamber 43 to provide a path through which the auxiliary crucible 41 goes out of the gate 45.

The auxiliary crucible 41 may be transported by a separate transportation means (not shown) from the auxiliary crucible chamber 43 up to the top of the crucible 30 and then supply the crucible 30 with the molten metal contained therein.

Meanwhile, such molten metal supplies 40 may sequentially supply the molten metal simply using two or more melting furnaces (not shown) without a separate chamber or the like.

Referring to FIG. 3, the rapid solidification apparatus according to the present invention may include a first chamber C1 which forms a space where the molten metal supplied from the crucible 30 is cooled by the cooling roll 10, and a second chamber C2 which forms a space where the molten metal is supplied to the crucible 30 by the molten metal supply 40.

At this time, it is preferred that the first chamber C1 and the second chamber C2 are formed as sealed independent spaces, respectively. For example, the first chamber C1 and the second chamber C2 may be separated by a chamber partition CP. With such a configuration, the vacuum process may be performed in the first chamber C1.

That is, the first chamber C1 may perform the cooling process efficiently by controlling the vacuum level, and the second chamber C2 may supply the cooling roll 10 with the molten metal contained in the crucible 30 at a constant pressure by producing an inert atmosphere and controlling the pressure according to the exhausted level of the molten metal contained in the crucible 30.

The related specific components and descriptions thereof will be given below.

Figure 4:
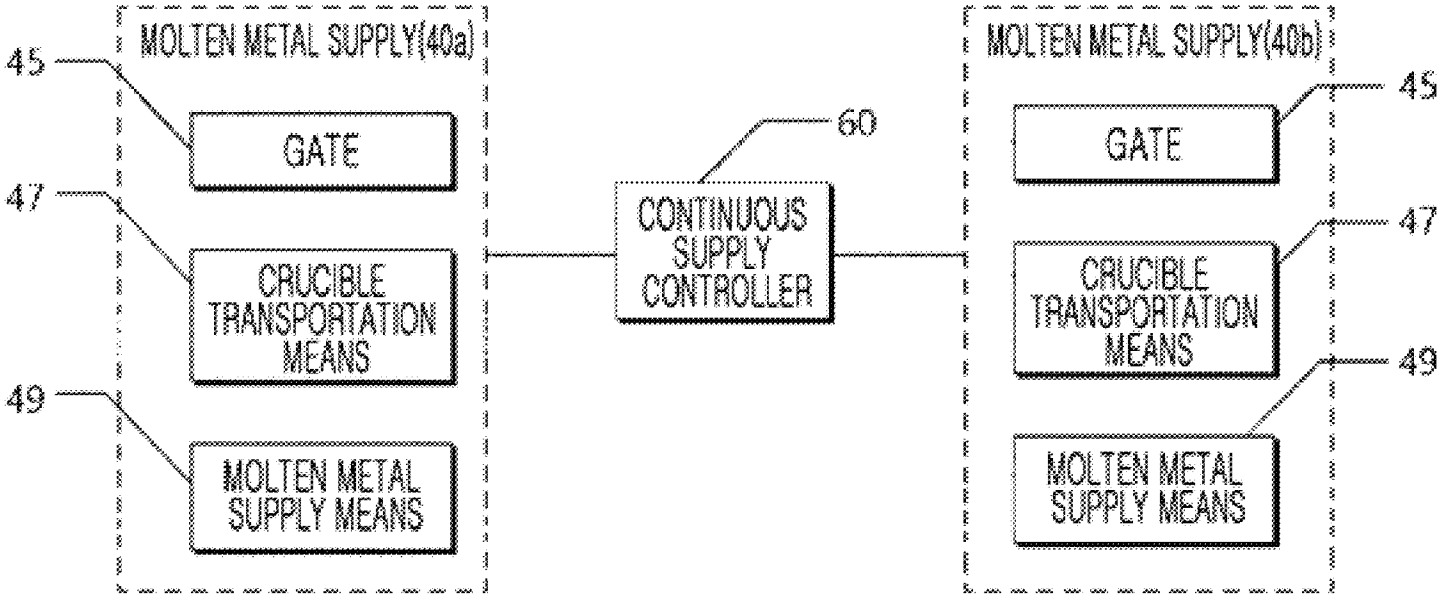
FIG. 4 is a block diagram illustrating components related to a control of a molten metal supply among a rapid solidification apparatus according to an embodiment of the present invention.

A continuous supply controller and a controller for the pressure and the vacuum level according to an embodiment will be described with reference to FIGS. 3 to 5. FIG. 4 is a block diagram illustrating a configuration related to a control of a molten metal supply of a rapid solidification apparatus according to an embodiment, and FIG. 5 is a block diagram illustrating components related to a vacuum level of a first chamber and a pressure control of a second chamber in a rapid solidification apparatus according to an embodiment.

Referring to FIGS. 3 and 4, the rapid solidification apparatus according to the present embodiment may further comprise a continuous supply controller 60.

The continuous supply controller 60 is a component which controls components illustrated in FIG. 3 so that the molten metal is sequentially supplied from a number of molten metal supplies 40 to the crucible 30. In case of an auxiliary crucible type, specifically, the continuous supply controller 60 sequentially opens and closes gates of the molten metal supplies 40*a* and 40*b* and then controls a crucible transportation means 47 to transport the auxiliary crucible so that the auxiliary crucible is transported toward the crucible. When the auxiliary crucible is transported toward the crucible, the continuous supply controller 60 controls the molten supply means 49 so that the molten metal is supplied from the auxiliary crucible to the crucible.

Figure 5:
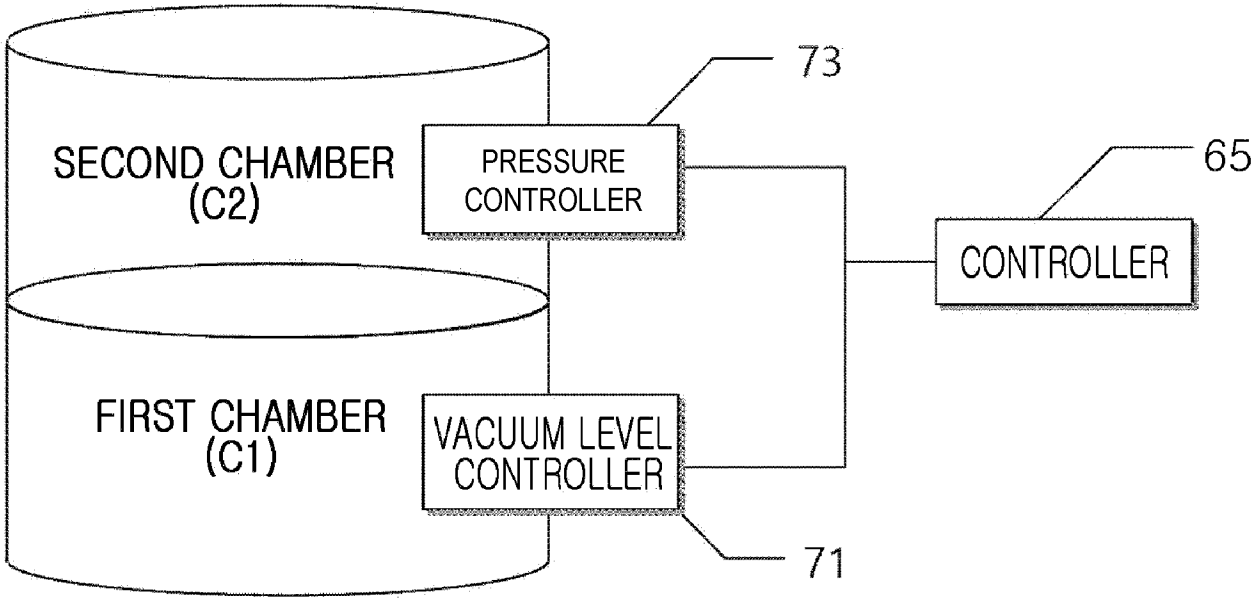
FIG. 5 is a block diagram illustrating components related to a vacuum level of a first chamber and a pressure control of a second chamber in a rapid solidification apparatus according to an embodiment of the present invention.

Referring to FIG. 5, the rapid solidification apparatus according to the present invention may include a vacuum level controller 71 and a pressure controller 73.

The pressure controller 73 may control the pressure in the second chamber C2, thereby controlling the pressure applied to the molten metal contained in the crucible. At this time, the pressure controller 73 may control the pressure by supplying the second chamber C2 with an inert gas.

The vacuum level controller 71 may control the vacuum level in the first chamber C1. At this time, it is preferred that the vacuum level of the first chamber C1 is controlled in the scope of 0.1 to 10 torr. There occurs a problem that a rapid solidification speed is reduced at the low vacuum level of 10 torr or more so that the cooling efficiency is low and the yield is reduced. Further, there occurs a problem that it may be difficult to produce such environment as the high vacuum level of 0.1 torr or less and a whirl occurs due to the rotation of the cooling roll 10, whereby a phenomenon occurs that a nozzle is rapidly cooled and closed.

Meanwhile, the controller 65 controls the pressure controller 73 and the vacuum level controller 71 so as to control the pressure of the second chamber C2 and the vacuum level of the first chamber C1, so that the final supply pressure of the molten metal supplied to the cooling roll through the crucible may be controlled.

Specifically, the controller 65 may control the pressure controller 73 to increase the pressure of the second chamber C2 in proportion to the exhausted status of the molten metal contained in the crucible. The molten metal contained in the crucible may be controlled to maintain a certain level as described above. However, the level of the molten metal contained in the crucible may be reduced in the process that a replacement is performed between the first auxiliary crucible and the second auxiliary crucible to supply the molten metal.

At this time, as the molten metal contained in the crucible becomes exhausted, the pressure in the second chamber C2 gradually becomes reduced and accordingly the pressure of the molten metal supplied to the cooling roll from the crucible also becomes reduced. Here, it may be possible to increase the pressure applied to supply the cooling roll with the molten metal contained in the crucible by increasing the internal pressure of the second chamber C2 in proportion to the exhausted status of the molten metal contained in the crucible.

Further, the controller 65 may also increase the vacuum level of the first chamber in proportion to the exhausted status of the molten metal supplied to the crucible. It may be possible to control the vacuum level controller 71 in order to increase the vacuum level of the first chamber C1 in proportion to the exhausted status of the molten metal contained in the crucible in the similar manner that the pressure in the second chamber C2 is increased according to the status of the molten metal contained in the crucible. As the vacuum level of the first chamber C1 increases, the pressure of the second chamber C2 relative to the first chamber C1 gradually increases. Using such a method, it may be possible to obtain the effect similar to that the pressure of the second chamber C2 is gradually increased.

Also, the controller 65 may simultaneously control the vacuum level of the first chamber C1 and the pressure of the second chamber C2. For example, it may also be possible to gradually increase the vacuum level of the first chamber C1 and the pressure of the second chamber C2 simultaneously in proportion to the exhausted status of the molten metal contained in the crucible. Even in case that the molten metal contained in the crucible is exhausted like the above-described technologies, it may be possible to maintain a constant pressure of the molten metal supplied from the crucible to the cooling roll by maintaining the pressure of the second chamber C2 at a suitable level.

Although preferred embodiments of the present invention have been described, technical ideas of the present invention are not limited to the preferred embodiments, and they may be variously embodied within the scope without departing from the technical ideas of the present invention specified in the appending claims.

The invention claimed is:

1. A continuous rapid solidification apparatus, comprising:

a cooling roll configured to cool a molten metal supplied to an outer circumference surface thereof;

a crucible configured to supply the cooling roll with the molten metal;

two or more molten metal supplies configured to melt a raw material metal and supply the crucible with the molten metal;

a first chamber configured to form a sealed space where the molten metal supplied from the crucible is cooled by the cooling roll;

a second chamber configured to be formed of a space separated from the first chamber by a chamber partition and the molten metal in the crucible and to form a sealed space where the molten metal is supplied to the crucible by the molten metal supply;

a vacuum level controller configured to control a vacuum level of the first chamber;

a pressure controller configured to control a pressure of the second chamber; and a controller configured to control the vacuum level controller and the pressure controller so as to increase the vacuum level of the first chamber and increase the pressure of the second chamber in proportion to an exhausted status of the molten metal supplied to the crucible, wherein each of the two or more molten metal supplies comprises:

an auxiliary crucible chamber including an internal heater;

a gate configured to open and close the auxiliary crucible chamber; and an auxiliary crucible configured to melt the raw material metal in the auxiliary crucible chamber and to be transported toward the crucible when the gate is opened so as to directly supply the crucible with the molten metal, wherein the cooling roll moves a cooled material of the molten metal in a certain direction such that the cooled material flows in the certain direction and is rolled up and stored in a storage.

2. The continuous rapid solidification apparatus of claim 1, wherein the pressure controller provides an inert gas into the second chamber to control the pressure therein.

3. The continuous rapid solidification apparatus of claim 1, further comprising a controller configured to control the vacuum level controller so as to increase the vacuum level of the first chamber in proportion to the exhausted status of the molten metal supplied to the crucible.

4. The continuous rapid solidification apparatus of claim 1, wherein the vacuum level of the first chamber is in a range of 0.1 to 10 torr.

5. The continuous rapid solidification apparatus of claim 1, wherein the two or more molten metal supplies have a melting furnace that melts the raw material metal contained therein.

6. The continuous rapid solidification apparatus of claim 1, further comprising a continuous supply controller configured to control opening and closing of the gate and transportation of the auxiliary crucible such that the molten metal is sequentially supplied from the two or more molten metal supplies.

* * * * *